US009163628B2

(12) United States Patent
Duncan et al.

(10) Patent No.: US 9,163,628 B2
(45) Date of Patent: Oct. 20, 2015

(54) SELF ADJUSTING GEAR PUMP

(71) Applicant: IMO Industries, Inc., Hamilton, NJ (US)

(72) Inventors: Patrick Wilson Duncan, Marshville, NC (US); Colette Doll Greene, Mint Hill, NC (US); Philip Taylor Alexander, Matthews, NC (US)

(73) Assignee: IMO Industries, Inc., Hamilton, NJ (US)

( * ) Notice: Subject to any disclaimer, the term of this patent is extended or adjusted under 35 U.S.C. 154(b) by 156 days.

(21) Appl. No.: 13/794,179

(22) Filed: Mar. 11, 2013

(65) Prior Publication Data

US 2014/0255235 A1 Sep. 11, 2014

(51) Int. Cl.

| | |
|---|---|
| ***F04C 2/10*** | (2006.01) |
| ***F01C 21/10*** | (2006.01) |
| ***F04C 14/26*** | (2006.01) |

(52) U.S. Cl.

CPC ..... *F04C 2/101* (2013.01); *F01C 21/10* (2013.01); *F04C 14/265* (2013.01); *F04C 2230/60* (2013.01); *Y10T 29/49242* (2015.01)

(58) Field of Classification Search

CPC ..... F01C 21/10; F04C 14/265; F04C 2/101
See application file for complete search history.

(56) References Cited

U.S. PATENT DOCUMENTS

| | | | | | |
|---|---|---|---|---|---|
| 1,694,805 | A | * | 12/1928 | Wiltse | 418/133 |
| 2,642,001 | A | * | 6/1953 | Dale et al. | 418/133 |
| 4,253,803 | A | * | 3/1981 | Wormmeester et al. | 417/283 |
| 5,674,060 | A | | 10/1997 | Buchmuller et al. | |

FOREIGN PATENT DOCUMENTS

| | | | | |
|---|---|---|---|---|
| CN | 202370833 | U | | 8/2012 |
| CN | 202370833 | U | * | 8/2012 |
| JP | 2005344624 | A | | 12/2005 |
| WO | 2008146352 | A1 | | 12/2005 |
| WO | 2009019185 | A1 | | 2/2009 |
| WO | 2011158167 | A2 | | 12/2011 |

* cited by examiner

*Primary Examiner* — Mary A Davis
(74) *Attorney, Agent, or Firm* — Kacvinsky Daisa Bluni PLLC

(57) ABSTRACT

A self-adjusting gear pump is disclosed. The pump may be a crescent internal gear pump, a gerotor pump, or an external gear pump. The pump includes a pump housing, gear housing, first and second gears, a side plate housing with a side plate, a shim and an end plate. The side plate moves between a first position contacting the first and second gears and gear housing, and a second position contacting the end plate. The side plate is spring biased toward the first position. A method is disclosed for match grinding the crescent plate (if used), gear housing and gears as a unit to provide a uniform surface. The side plate housing and side plate are similarly match ground. An assembly method is disclosed which allows the crescent plate to be moved with respect to the gear housing so that clearances between the crescent and the gear teeth are eliminated.

8 Claims, 19 Drawing Sheets

SELF ADJUSTING GEAR PUMP

FIELD OF THE DISCLOSURE

The disclosure is generally related to the field of gear pumps, and more particularly to a self-adjusting gear pump having enhanced efficiency at low and high speeds, and which minimizes the impact of tolerance stack-ups and machining variances on pump performance.

BACKGROUND OF THE DISCLOSURE

In the diesel engine market it is common for fuel pumps (primarily rotary gear pumps) pumping low viscosity fluid (as low as 0.9 centistokes (cst)) to be required to run from very low speeds (below 100 RPM) and moderate pressures to relatively high speeds (in excess of 3000 RPM) at increasingly higher pressures. A problem with this is that gear pumps that are capable of running at higher speeds are typically not efficient at low speed operating points and gears pumps that have excellent low speed efficiencies are not typically capable of operating at elevated speeds. This creates a circular problem for the end user because in order for the pump to meet required flow rates at the lower speeds, it must be grossly oversized at the high speed conditions. This causes the end user to have a system that may produce two to three times more flow than they actually need at elevated speeds, requiring all of the excess flow to be dumped back to the system as unusable energy. With increasing demand for cleaner burning engines and more efficient systems, this is a large hurdle that needs to be overcome.

In addition, another problem that affects the performance and repeatability of one pump of the same type when compared to another is the problem of tolerance stack and machining variance from one pump to another. Due to cost and standard machining practices utilized when building and assembling pumps of this type, pump dimensions can vary (within tolerance) from part to part. These variances when added together can cause pump performance to be inconsistent between two pumps of the same design. These inconsistencies can also push pump efficiencies out of the acceptable range. The intent of this invention is to also minimize the effect of these machining variances and to create a more efficient and repeatable pump.

In the past others have tried several methods of improving the low speed efficiency of rotary pumps. Two of the most common methods include reducing mechanical clearances in the pump, and the addition of pressure biased or pressure balanced side plates. Both approaches have issues at low viscosities with elevated speeds and pressures.

When pumping low viscosity fluid, if the clearances in the pump are simply reduced there is a fine balancing act between good efficiency at low speed and enough clearance to keep the pump from seizing as it heats up and thermal expansion takes place. If the clearances are too wide the pump is not efficient. If the clearances are too tight the pump will have a mechanical failure, thus this method is very application specific and usually requires multiple iterations to get a compromised solution. This solution rarely provides an optimum pump sizing for both the low speed and high speed operating points.

The approach of using pressure biased side plates is a common and effective solution especially for low speed and low pressure applications with higher viscosity fluids. With this solution as pressure of the pump increases, the pressure behind the side plate increases, forcing the side plate tighter against the gears, thus closing the clearances in the pump tighter and tighter as pressure increases. This works well for high viscosity, low speed and moderate pressure applications and efficiencies have been shown to increase dramatically. However, with this concept as pressure increases greatly or speed increases greatly there is a large amount of heat generated due to friction. This heat eventually causes the side plates to fail and often seizes the pump.

The same is true with pressure balanced side plate designs. With this type of design the side plate is sized so that the pressure closing the side faces is nearly perfectly balanced so that the side plate does not rub as hard on the rotating gears as pressure increases. This concept works great for high viscosity and low to high pressure ranges, but is limited again to lower speeds operations. As speed increases, even though the side plates are balanced, the clearances remain the same thus heat is generated and the pump eventually fails.

In view of the above, there is a need for an improved gear pump design that improves both the low speed efficiency of the pump as well as creates a design that can still operate at the elevated speeds for extended periods.

SUMMARY OF THE DISCLOSURE

A self-adjusting gear pump is disclosed. The pump may include a gear housing with first and second gears disposed therein. A side plate housing may be coupled to the gear housing. A side plate may be positioned within the side plate housing, the side plate having first and second opposing faces. An end plate may be coupled to the side plate housing. A shim member may be coupled between the side plate housing and the end plate. The side plate may be axially movable between a first position in which the first face contacts respective faces of the pinion gear, ring gear and gear housing, and a second position in which the second face contacts the end plate. The first face of the side plate may be biased toward the first position via a biasing member positioned between the side plate and the end plate.

A method is disclosed for manufacturing a gear pump assembly. The method may include assembling a crescent plate and a gear housing together, the crescent plate having a plate portion and a crescent portion, the gear housing having a pinion gear and a ring gear disposed therein, the crescent portion disposed between a portion of the pinion gear and the ring gear, and grinding respective faces of the gear housing, crescent portion, pinion gear and ring gear as a single unit to provide a finished flat gear assembly surface. The method may also include assembling a side plate housing and a side plate together, and grinding respective faces of the side plate housing and the side plate as a single unit to provide a finished flat side plate assembly surface. The method may further include coupling the crescent plate, gear housing, pinion gear and ring gear with the side plate housing and the side plate so that the finished flat gear assembly surface contacts the finished flat side plate assembly surface.

A method is disclosed for assembling a gear pump. The method may include: engaging a crescent plate with a pump housing, the pump housing having first and second projections received within first and second elongated openings in the crescent plate; engaging a pinion gear with a pump shaft so that the pinion gear is positioned adjacent to a crescent portion of the crescent plate; engaging a gear housing with the crescent plate; engaging a ring gear with the gear housing so that the ring gear is positioned adjacent to the crescent portion and so that teeth of the ring gear mesh with corresponding teeth of the pinion gear; and moving the gear housing with respect to the pump housing so that the teeth of the ring gear contact an outer surface of the crescent portion and the teeth of the pinion gear contact an inner surface of the crescent portion.

A method is disclosed for assembling a gear pump. The method may comprise: engaging a gear housing with a pump housing; engaging first and second gears with the gear housing; and providing a side plate in a side plate housing. The gear housing, the pinion gear and the ring gear may be match ground as a single unit to provide a uniform gear housing assembly surface. The side plate and side plate housing may be match ground to provide a uniform side plate assembly surface. The method may further comprise engaging the side plate and side plate housing with the gear housing and the first and second gears such that the side plate assembly surface contacts the gear housing assembly surface.

BRIEF DESCRIPTION OF THE DRAWINGS

By way of example, a specific embodiment of the disclosed device will now be described, with reference to the accompanying drawings.

DETAILED DESCRIPTION

In certain applications the pressure profile for pump operation starts at a low pressure (e.g., 30-100 psi) and at extremely low speed (e.g., less than about 100 RPM), often referred to as a "startup condition") then ramps up to a stable higher pressure (e.g., above 100 psi) at some intermediate speed (e.g., between 300-4000 RPM) This same elevated pressure is then maintained for all operating speeds above the low speed idle condition. Standard crescent internal gear pumps have excellent efficiency on low viscosity fluids, such as diesel fuel, at typical diesel fuel pressures, where pump speed is at or above low speed idle. Thus standard clearances are preferred at these operating points since the pumps have been proven to have very long life with these established clearances. The same may not be said about operating at low speed and low pressure (i.e., startup conditions) with such standard clearances.

To improve pump performance at low speed and low pressure operating conditions, a gear pump design is disclosed in which a side plate of the pump is spring biased into engagement with the gears when the pump pressure is between the startup pressure and the normal operating pressure of the pump. This arrangement causes the pump clearances to be tight when needed during startup but allows the clearances to open up once the startup condition is surpassed (i.e., when pump pressure exceeds the pressure exerted by the spring). This solves both the low speed efficiency issue and the longevity issue at elevated speeds and pressures. Thus, the long term effect is a pump that is sized appropriately to a particular system, and which also minimizes or eliminates energy waste associated with pumping unused fluid. It will be appreciated that the aforementioned pressure and speed ranges are merely exemplary, and the disclosed pump is not limited to operating within such ranges.

Figure 1:
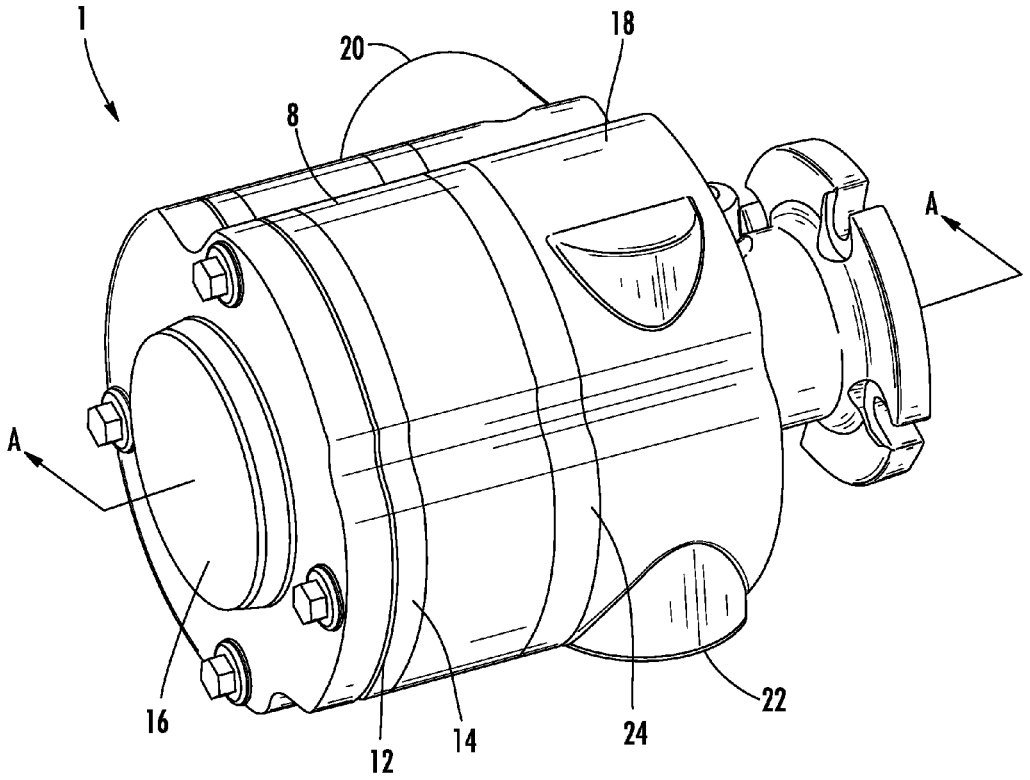
FIG. 1 is an isometric view of an exemplary gear pump according to the disclosure.
Figure 2:
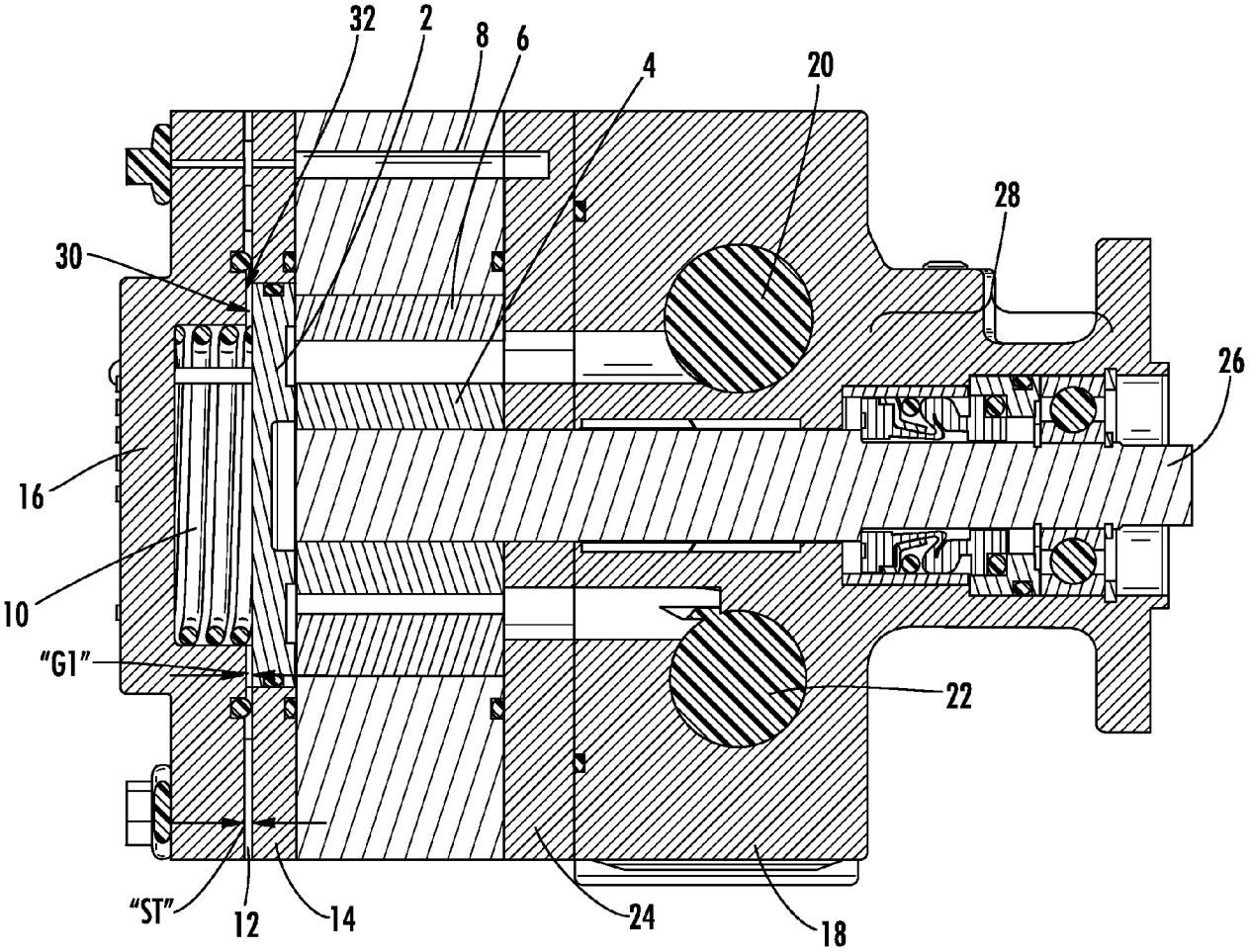
FIG. 2 is a cross-section view of the gear pump of FIG. 1 taken alone line A-A.
Figure 3:
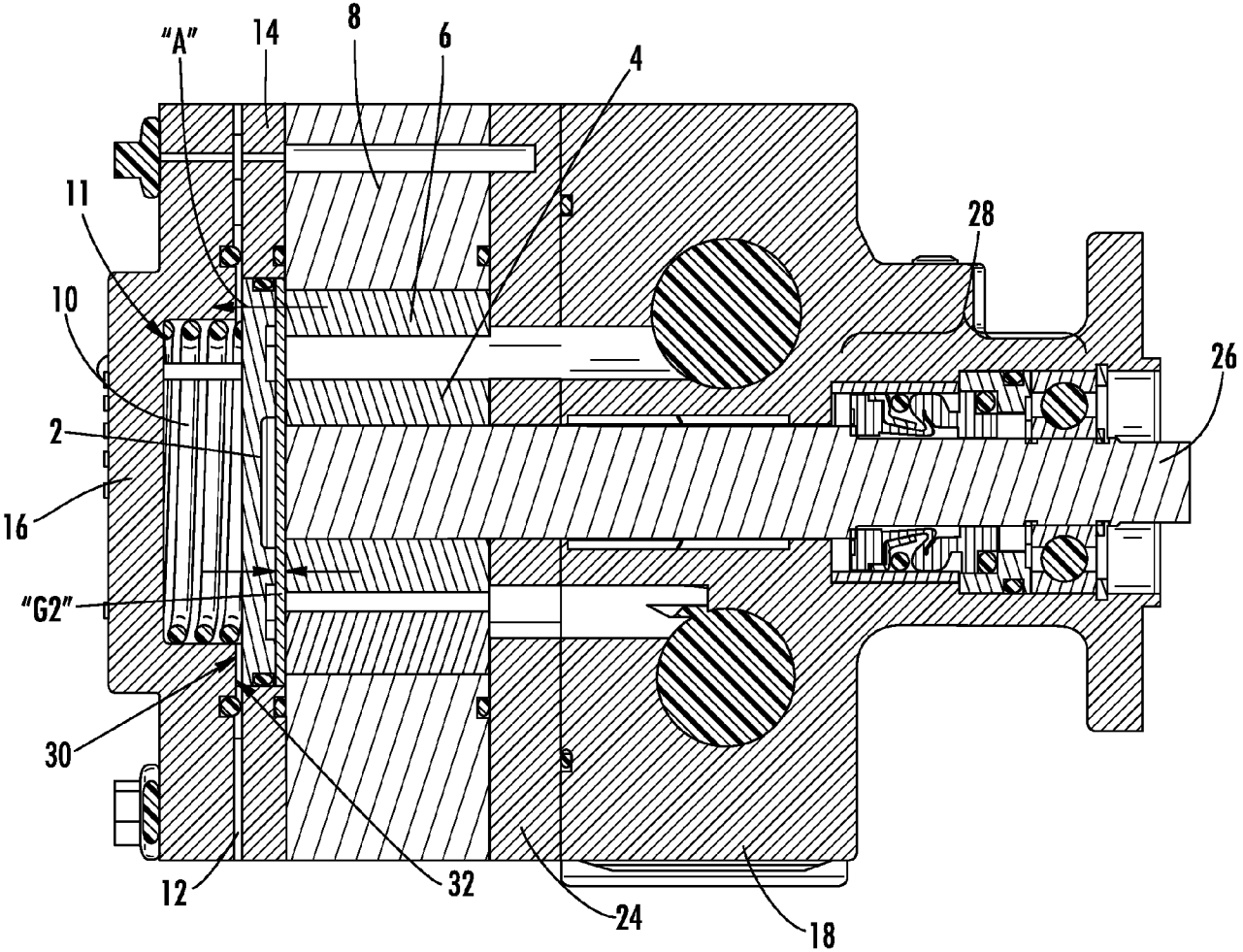
FIG. 3 is an alternative cross-section view of the gear pump shown in FIG. 2.

In one embodiment, shown in FIGS. 1-3, a gear pump 1 includes a self-adjusting side plate 2 that is biased toward the pinion and ring gears 4, 6 and gear housing 8 using a spring 10 disposed in a recess 11 formed in the pump end plate 16. This biasing arrangement sets the axial clearances between the side plate 2 and the gear faces to zero when the pump is running at low speeds, thereby eliminating a low speed slip (i.e., leak) path. The spring 10 may be sized to force the side plate toward the gears 4, 6 and gear housing 8 only when the discharge pressure is low. Such a condition typically occurs during engine cranking, when pump efficiencies are normally low. The spring 10 may be sized so that the spring force will be overcome once the pump pressure rises above startup pressure, which normally occurs at a midpoint between startup speed and pressure and a predetermined speed and pressure where pump efficiencies are proved to be acceptable with standard clearances. In exemplary non-limiting embodiments, the spring may have a spring force from 10 pounds to 1000 pounds. It will be appreciated that the spring force value will vary widely depending upon the pump user's discharge pressure conditions and speeds and how they vary between startup and full speed. At this point the side plate 2 will move away from the pinion and ring gears 4, 6 and gear housing 8 to a point of maximum clearance between the side plate and gears. This maximum clearance may be a "proven" clearance that is a standard for pumps of this design. This maximum clearance may be set using a carefully sized shim 12 positioned between a side plate housing 14 and end cover 16.

Referring to FIG. 1, the exemplary pump 1 includes a pump housing 18 having suction and discharge ports 20, 22, and a stacked arrangement including a crescent plate 24, gear housing 8, side plate housing 14, shim 12 and end cover 16. As can be seen in FIGS. 2 and 3, a pump shaft 26 may be axially received through the stack so that a distal end of the shaft engages the pinion gear 4. The pump shaft 26 may be supported near its proximal end by a bearing and seal arrangement 28.

FIG. 2 shows the configuration of the pump 1 when discharge pressure is low (i.e., the startup condition) such that the force of spring 10 biases the side plate 2 into direct engagement with the pinion and ring gears 4, 6 and the gear housing 8. In this position, a gap "G1" exists between the rear surface 30 of the side plate 2 and a forward surface 32 of the end plate 16. In the illustrated embodiment this gap "G1" is the same as the thickness "ST" of the shim 12. FIG. 3 shows the configuration of the pump 1 when discharge pressure increases sufficiently to overcome the force of the spring 10, causing the side plate 2 to move in the direction of arrow "A" until the rear surface 30 of the side plate engages the forward surface 32 of the end plate 16. At this point, gap "G1" is extinguished, and a clearance "G2" is opened up between the side plate 2 and the pinion and ring gears 4, 6 and the gear housing 8.

The disclosed spring-loaded side plate is advantageous as compared to prior designs in that it only acts to close the pump side face clearances over the low speed low pressure range of operation (e.g., startup speeds). This improves the efficiency of the pump in the operating range where prior designs are often inadequate. Once the "startup" conditions and pressures are exceeded, the side plate moves to normal proven clearances allowing the pump to operate at high pressures and low viscosities with minimal reliability issues.

It will be appreciated that the shim thickness "ST" can be selected to provide a desired clearance "CG" between the side plate 2 and the pinion and ring gears 4, 6 and the gear housing 8 at higher pressure conditions. In non-limiting exemplary embodiments, the shim thickness "ST" can be from about 0.0001-inches to about 0.020 inches, depending upon the application.

It will also be appreciated that although the spring 10 is illustrated as being a coil spring, other types of biasing elements could be used, a non-limiting list including wave springs, Belleville washers, conical springs, magazine springs, air springs, leaf springs, volute springs, spring washers, wave washers, elastomers as springs, and tapered springs.

The disclosed self-adjusting side plate design has the advantage over previous side plate attempts in that it only attempts to reduce clearances through the operating range that it is needed. The self-adjusting plate only closes clearances at "cranking" conditions where pressure and speed are relatively low. Once these conditions are exceeded the side plate relieves and the pump opens itself up to normal proven clearances that can operate at high pressure and high speed. This is an advantage over previous technology that either tries to balance the pressure on both sides of the side plate or pressure bias the side plate always to close clearances. These designs cannot operate at low viscosities and high speeds for extended amounts of time without failure due to heat generation or thermal expansion.

Figure 4:
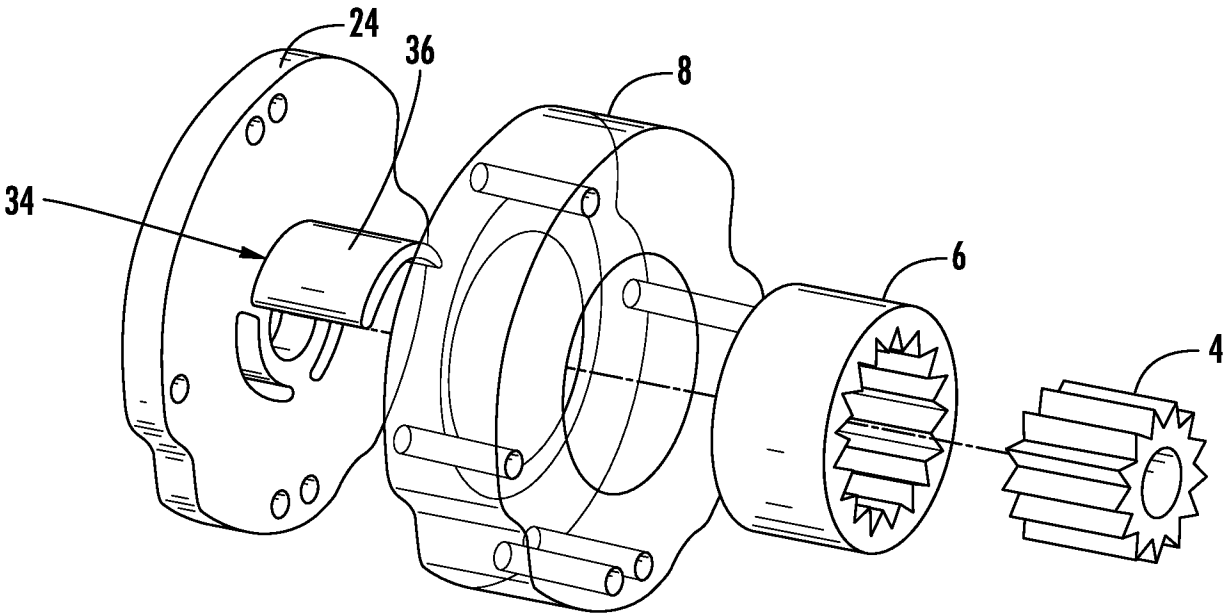
FIGS. 4-9 are a series of isometric views showing an exemplary manufacturing process for the pump of FIG. 1.

In addition to the self-adjusting side plates, the pump 1 may be manufactured and assembled in a manner that minimizes or eliminates tolerance stack-up issues and attendant pump performance issues. For example, as can be seen in FIG. 4, the gear housing 8 and crescent plate 24 may be separated into individual components rather than machined as a single piece. This has two distinct advantages to conventional methods. First, it allows the machinist to easily machine a sharp intersection at the base 34 of the crescent 36 without using a long slender boring bar that is often unstable. It also enables the gear manufacturer to provide pinion and ring gears 4, 6 with sharper edges rather than requiring an over-exaggerated chamfer. This is because a gear chamfer is no longer required to clear the radius or step that normally exists at the base 34 of the crescent when using conventional manufacturing techniques. The disclosed method eliminates another primary inefficiency and slip path in the pump 1, namely the gap created by a chamfer on the end of the pinion and ring gears 4, 6 that allows fluid to leak back through the pump.

The two piece crescent plate 24 and gear housing 8 has another distinct advantage in that it allows the radial gap between the crescent 36 and pinion gear 4, and the radial gap between the crescent and the ring gear 6, to be minimized during assembly. The two pieces are independent of each other and are allowed to "free float" or slide against each other in one dimension. The other axes of free motion are confined, thus maintaining orientation of the pieces in a desired position. During assembly this allows the gear housing 8 to be loaded into the ring gear 6, which is in turn is loaded into the crescent plate 24, which in turn is loaded into the pinion gear 4 during assembly. This eliminates all radial tolerance stack-up during assembly, which not only makes the pump more efficient, but it also allows the tolerancing of the parts to be more liberal and reduces manufacturing expense.

Referring now to FIGS. 4-9, a method for manufacturing the pump 1 will be described in greater detail. In general, the gear housing 8, crescent plate 24, pinion gear 4, and ring gear 6 are all match ground as an assembly during the manufacturing process. The side plate housing 14 and side plate 2 are also match ground as an assembly during the manufacturing process. This process has several distinct advantages over conventional methods. It eliminates the labor intensive task of setting side face clearances at assembly where the operator has to manually lap either the gears or housings and then repeatedly check the clearances of three parts with a gage until they are correct. With the pre match ground components the operator simply inserts the shim 12 between the end cover 16 and side plate housing 14 and bolts the pump 1 together. The shim 12 precisely sets the position of the side plate 2 and does so without any variation from one side to the other.

The match grinding process also eliminates variations caused by tolerance stack-up between the independently machined components. Typically when the operator attempts to set the side face clearances there is a variation from one side of the part to the other, even if all parts are within tolerance. With the disclosed method this variation can be minimized or eliminated, and performance repeatability will greatly improve.

Figure 5:
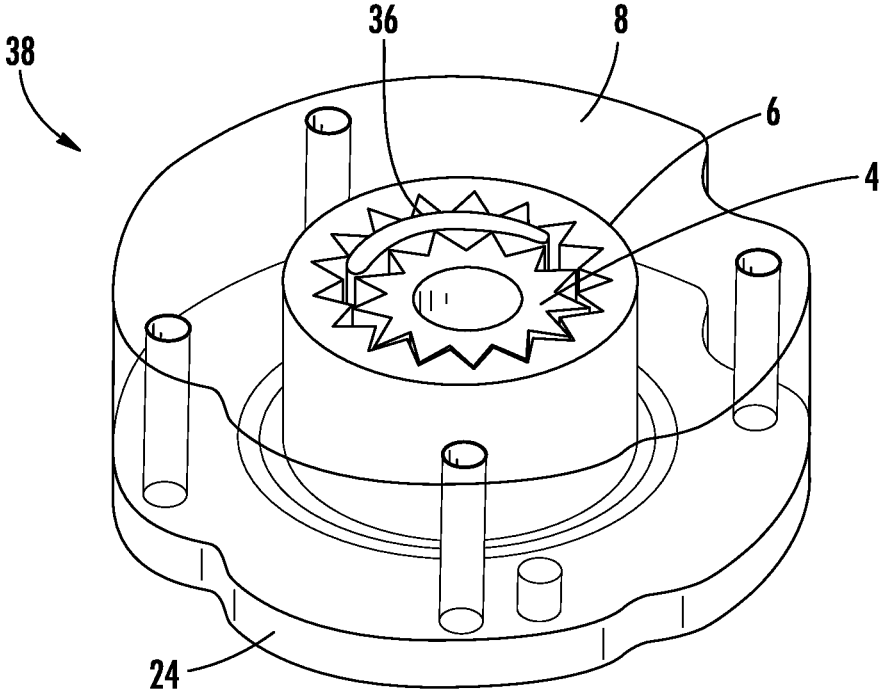

Moreover, the disclosed manufacturing method eliminates the need for costly adjustments while the pump is being assembled. It also allows for easier less costly machining options to improve pump efficiency. The individual manufacturing steps will be described in greater detail. FIG. 4 shows the relative placement of the crescent plate 24, gear housing 8, pinion gear 4 and ring gear 6. FIG. 5 shows the pieces assembled, with the crescent 36 positioned between a portion of the pinion gear 4 and ring gear 6. The assembly 38 may be fixed together and the faces of the assembled pieces can be ground as a single unit to achieve a uniform thickness for all of the pieces.

Figure 6:
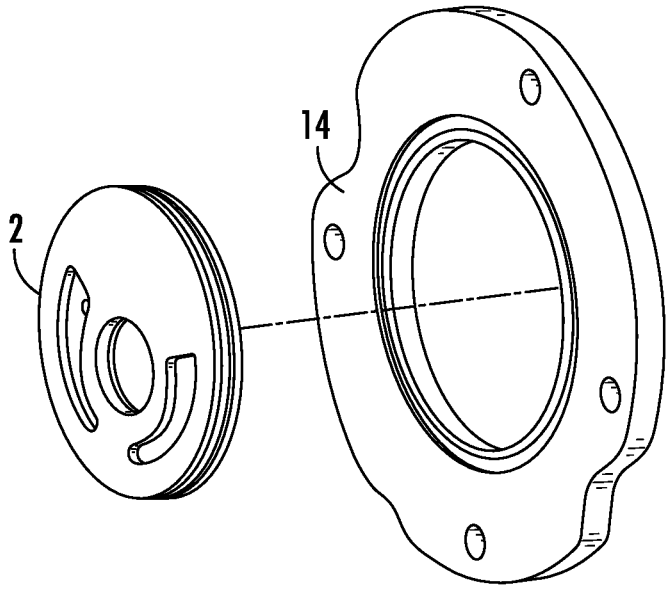
Figure 7:
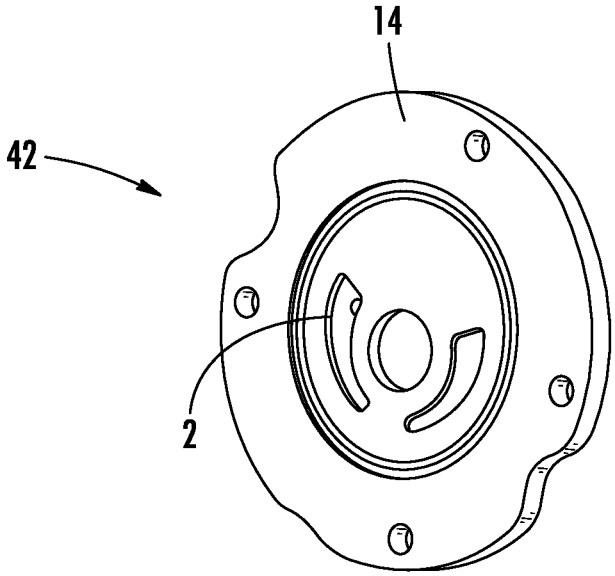

In similar fashion, FIG. 6 shows the relative placement of the side plate 2 and side plate housing 14. FIG. 7 shows the side plate 2 and side plate housing 14 assembled. This assembly 42 can be fixed together and the faces of the assembled pieces can be ground as a single unit to achieve a uniform thickness for both pieces.

Figure 8:
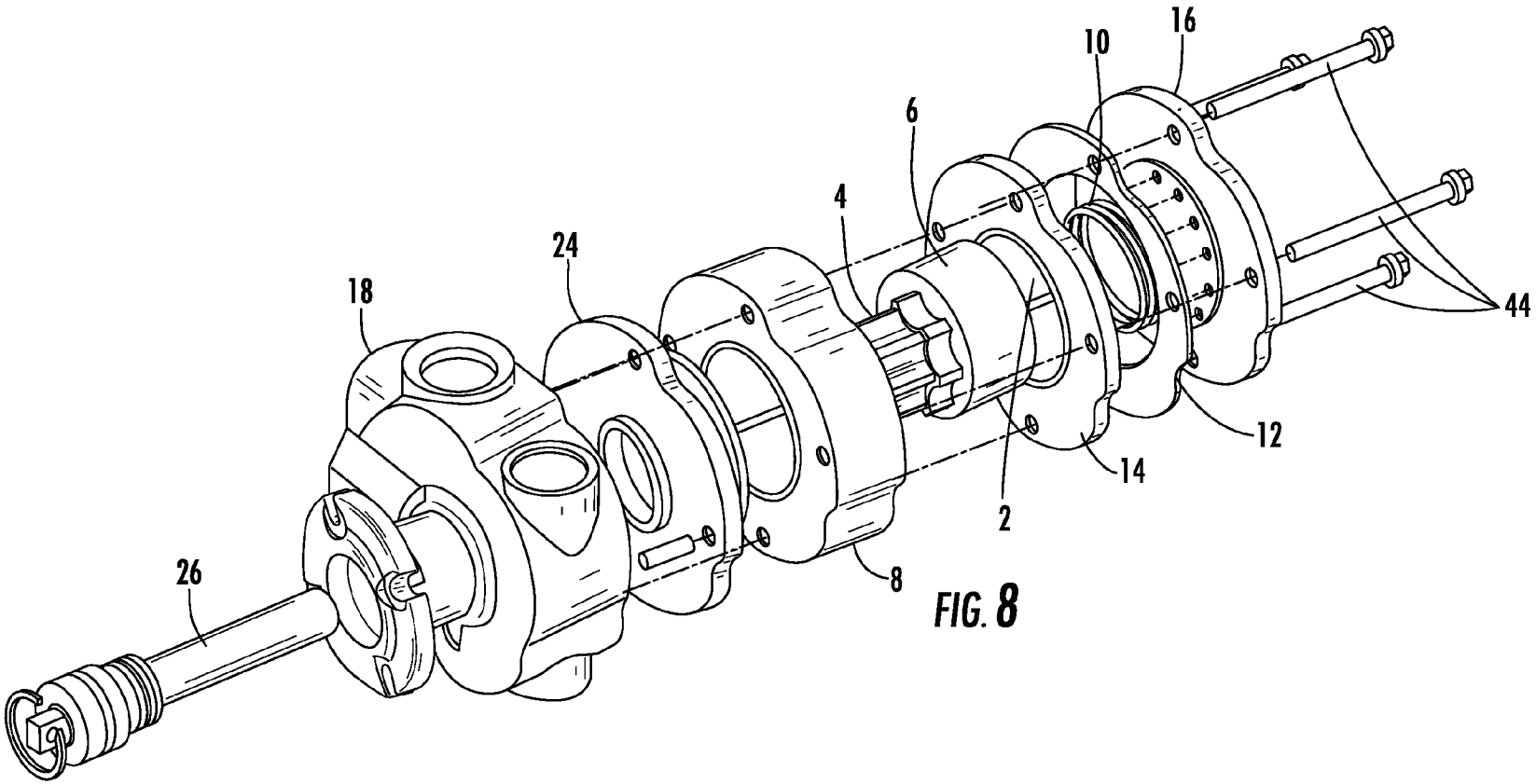
Figure 9:
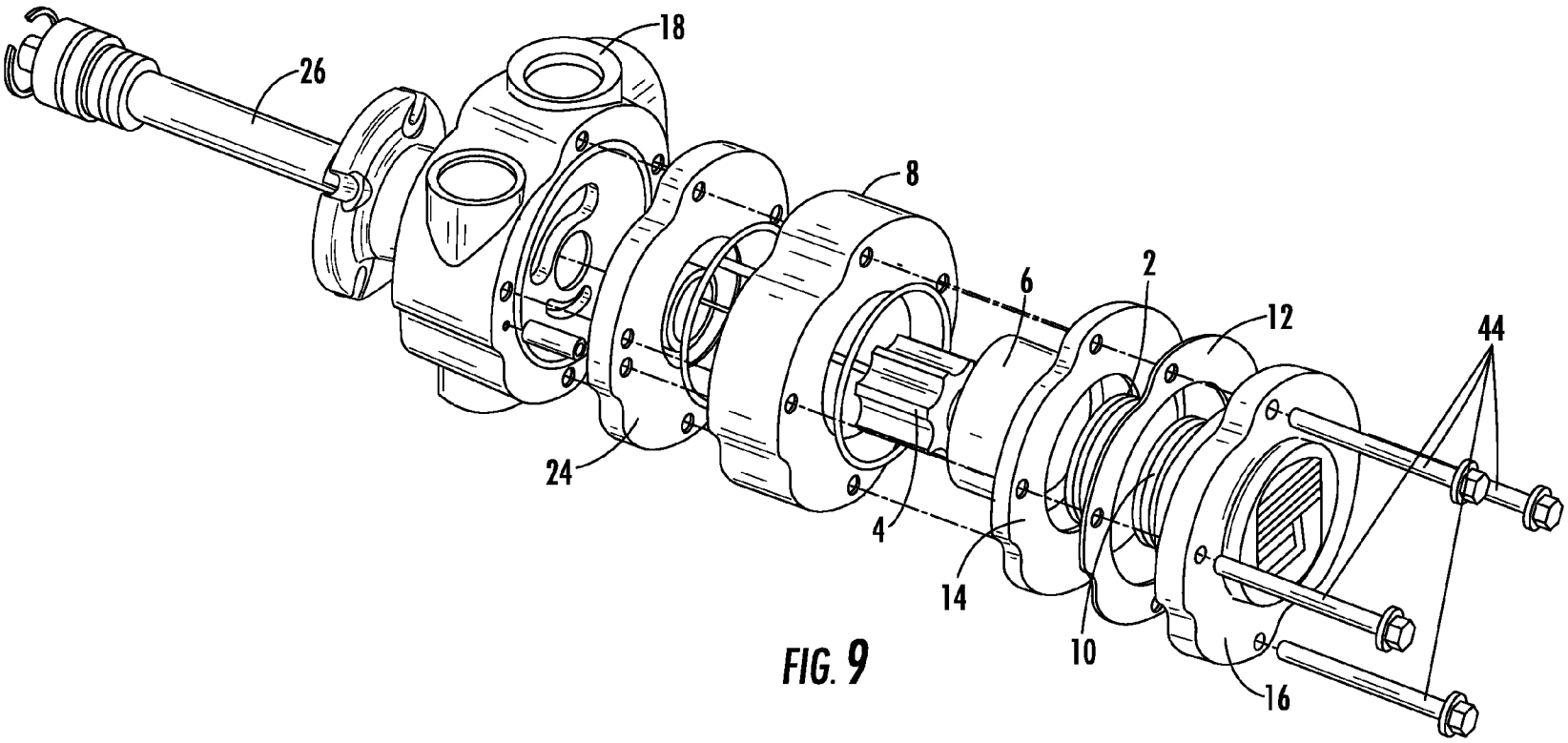

FIGS. 8 and 9 show the pump 1 arranged for assembly. In the illustrated embodiment, the pieces are fixed together using a plurality of fasteners 44. As previously described, the shim 12 establishes a desired side face clearance for high speed and high pressure operation. In addition, for low speed and low pressure conditions minimal to zero clearance can be maintained by loading the side plate 2 with spring 10. It will be appreciated that the spring 10 may be specifically sized for the particular desired operating conditions of the pump 1.

An exemplary assembly process according to the disclosure will now be described in relation to FIGS. 10-16. In addition to the previously described arrangement for making the disclosed gear pump more efficient, the method in which this pump is assembled can also increase pump efficiencies and can minimize the effect of machining tolerance variation on the individual pump components.

Figure 10:
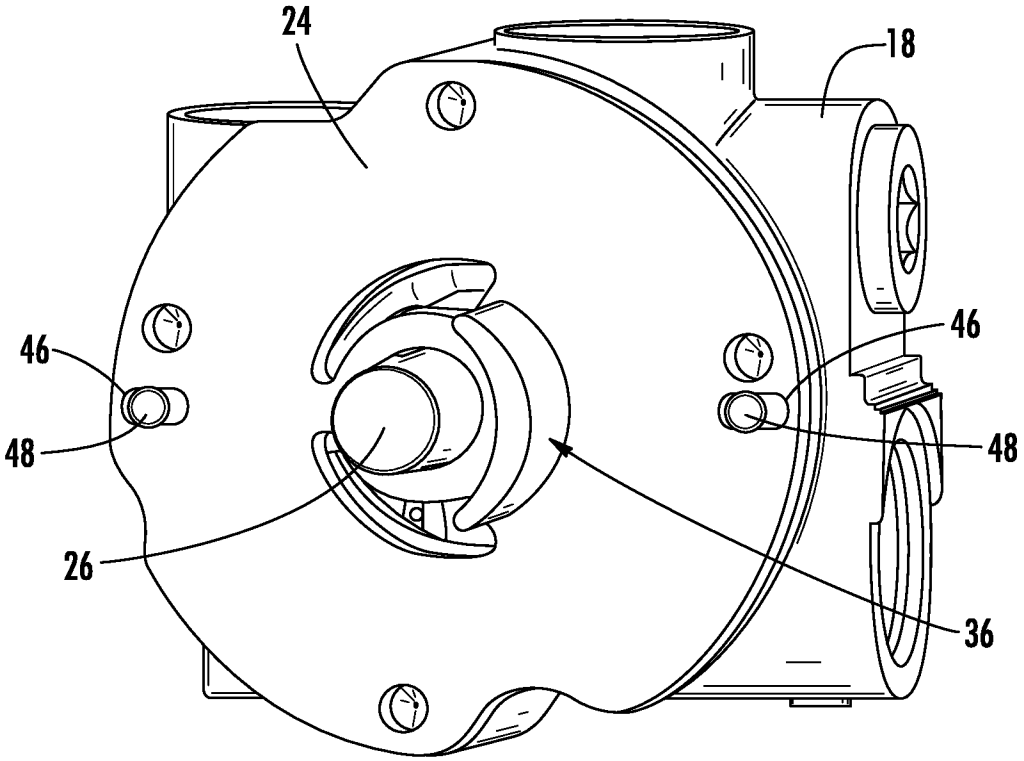
FIGS. 10-16 are a series of isometric views showing an exemplary assembly process for the pump of FIG. 1.
Figure 11:
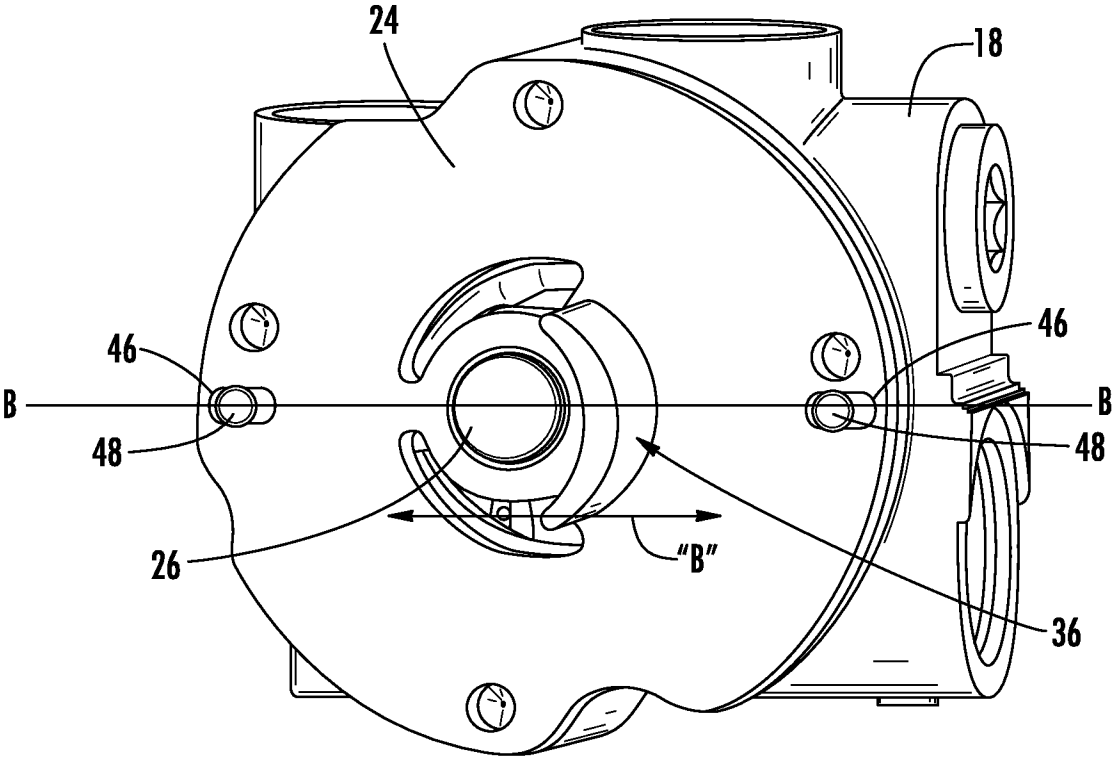

FIG. 10 shows the crescent plate 24 assembled on the pump housing 18 and pump shaft 26. The crescent plate 24 may include a pair of elongated holes 46 that receive respective pins 48 fixed to the pump housing 18. In the illustrated embodiment, the elongated holes 46 are oriented on opposite sides of the crescent 36 such that an elongation axis "B-B" (FIG. 11) running through the holes intersects the crescent. This placement is not critical, and the holes 46 could be located in other portions of the crescent plate 24 provided that they enable movement of the plate, and crescent 36, only along a single axis. Preferably this axis is oriented so that movement along the axis in one direction tends to move the crescent 36 toward the pump shaft 26. FIG. 11 shows the freedom of movement of the crescent plate 24 in the direction of arrow "B" along axis "B-B," bounded only by the interaction between the pins 48 and the holes 46.

Figure 12:
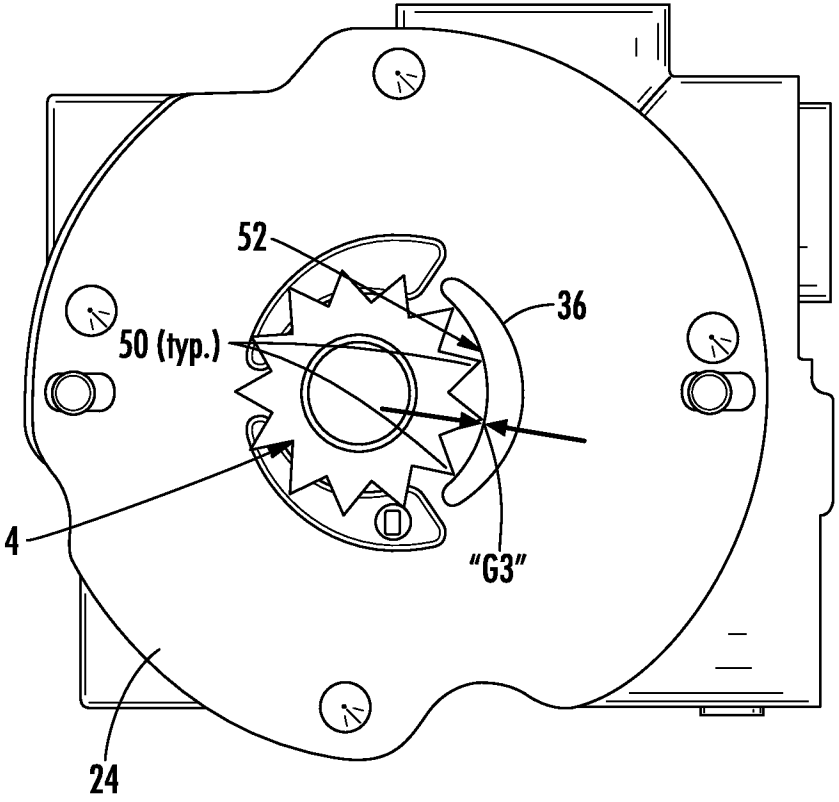

FIG. 12 shows the pinion gear 4 assembled on the shaft. As can be seen, at this point in the assembly process the pinion teeth 50 and the inner surface 52 of the crescent 36 are separated by clearances "G3." In operation, such clearances are undesirable and thus they will be closed up in further assembly steps.

Figure 13:
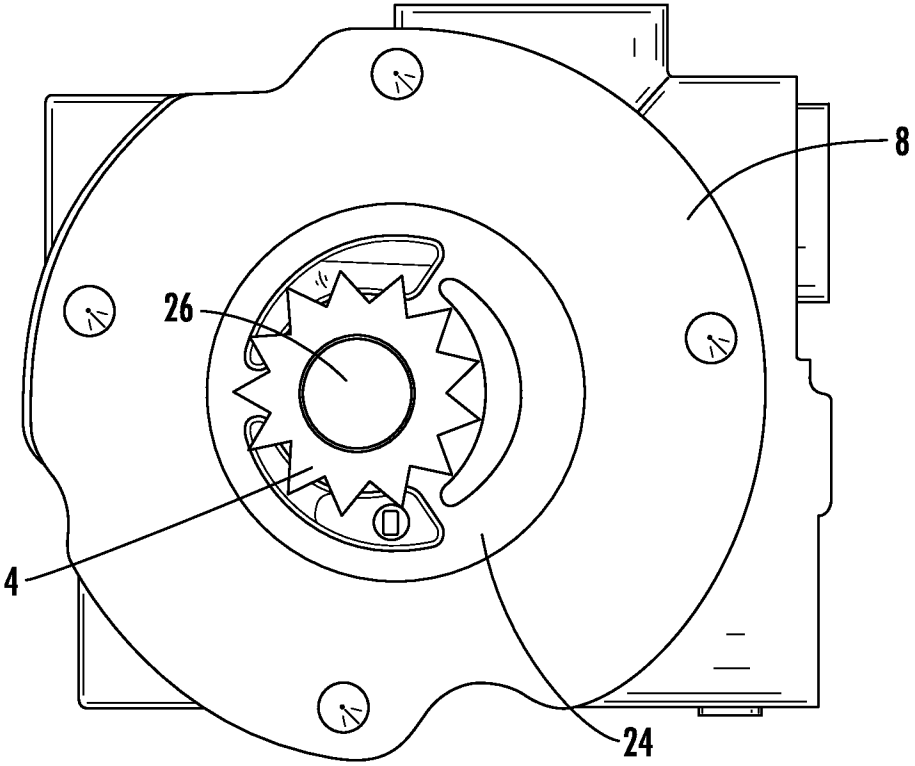
Figure 14:
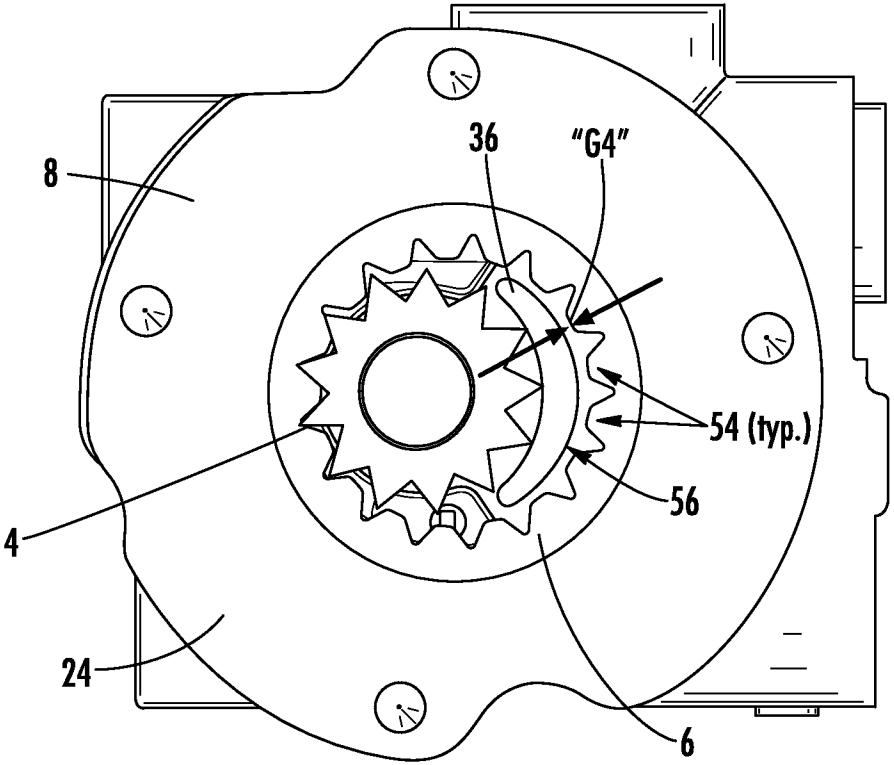

FIG. 13 shows the gear housing 8 assembled over the crescent plate 24, while FIG. 14 shows the ring gear 6 into the gear housing 8, and surrounding the crescent 36 and pinion gear 4. As can be seen, at this point in the assembly process the ring gear teeth 54 and the outer surface 56 of the crescent 36 are separated by clearances "G4." As with clearances "G3," these clearances "G4" are undesirable during operation and thus they will be closed up in further assembly steps.

Figure 15:
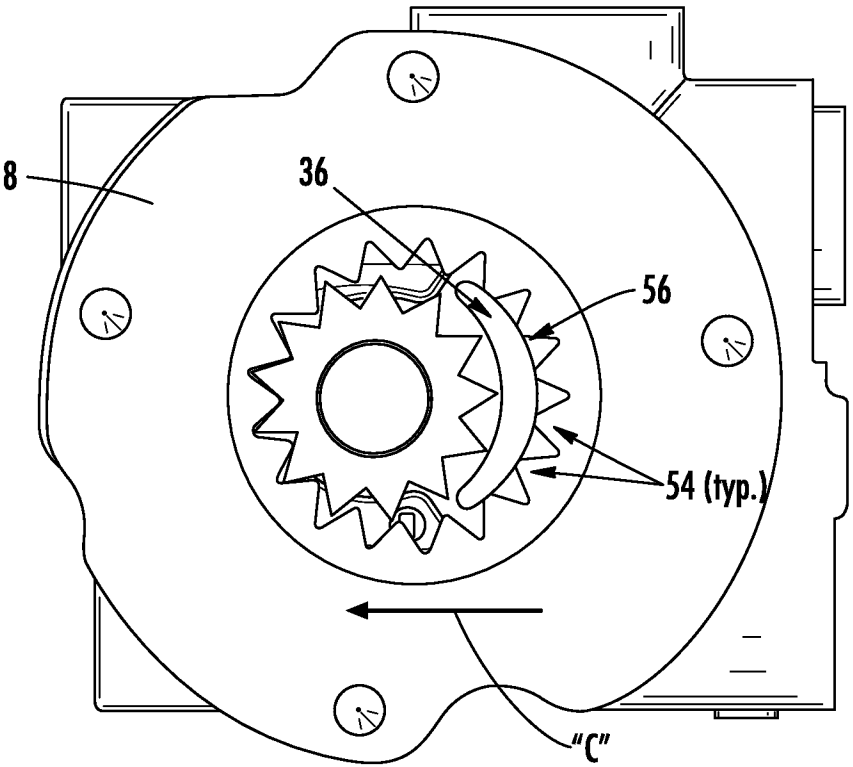
Figure 16:
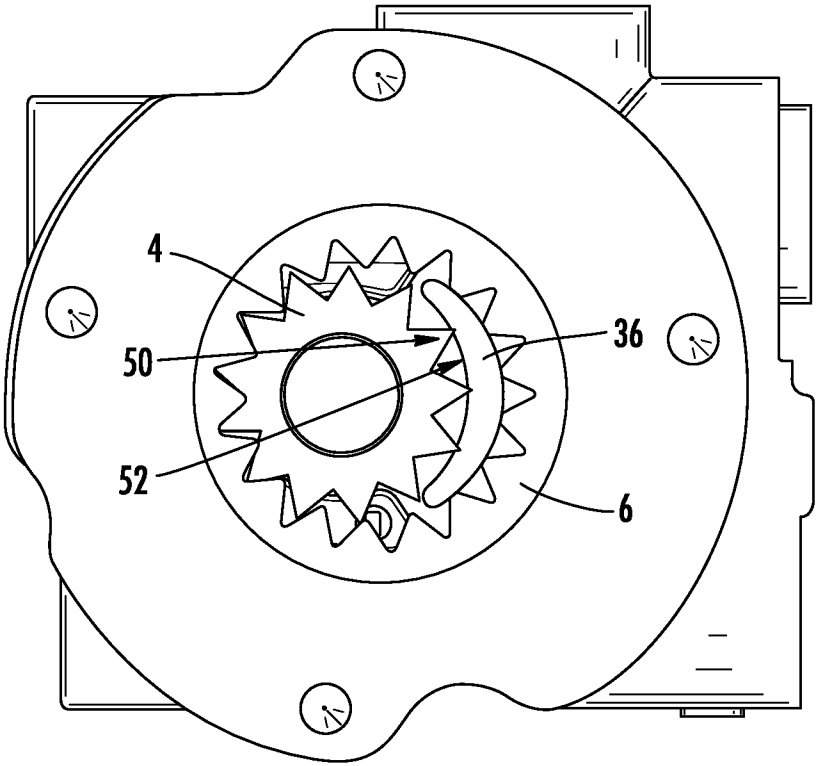

FIG. 15 shows the gear housing 8 moved along the direction of arrow "C" to force the ring gear teeth 54 to lightly contact the outer surface 56 of the crescent 36, eliminating clearance "G4," and thereby eliminating it as a leakage path during operation. FIG. 16 shows the crescent 36 being loaded into the ring gear 6 so that the inner surface 52 of the crescent engages the teeth 50 of the pinion gear 4, eliminating clearance "G3," and thereby eliminating it as a leakage path during operation.

Figure 17:
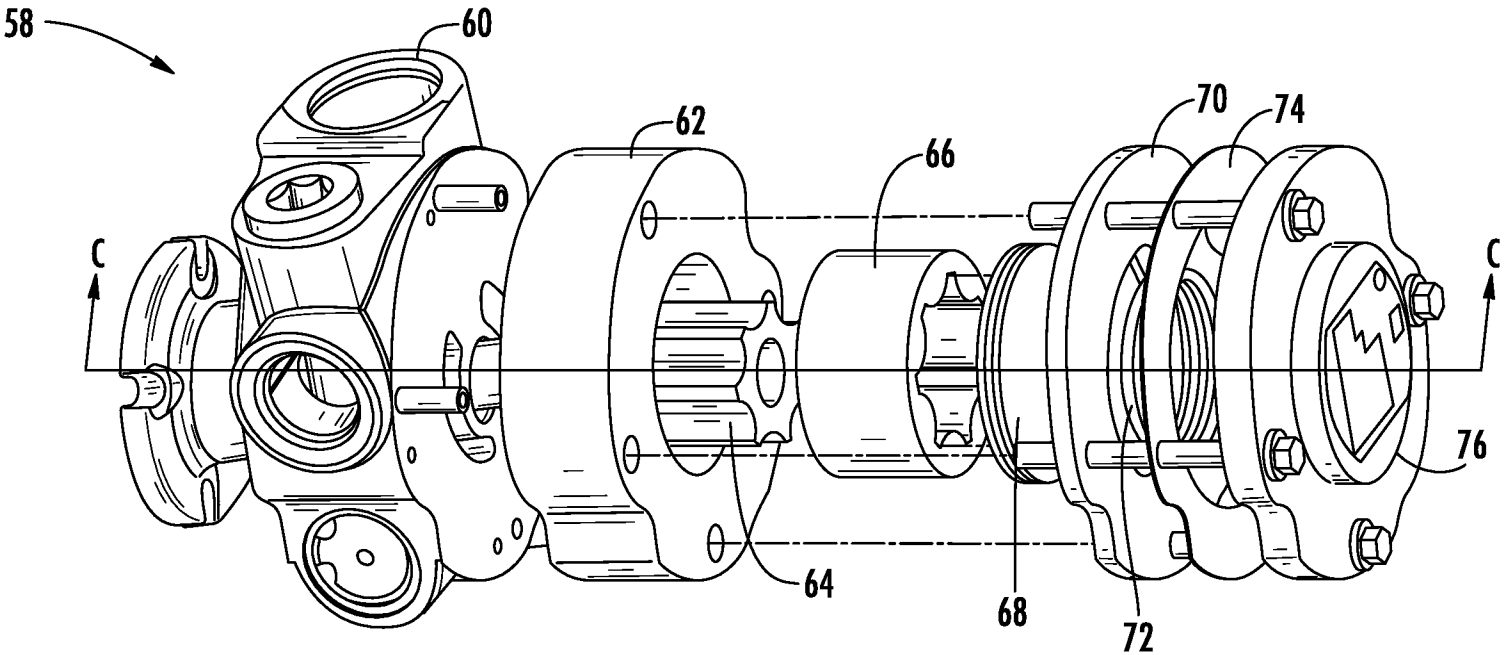
FIG. 17 is an exploded view of an exemplary gerotor pump according to the disclosure.
Figure 18:
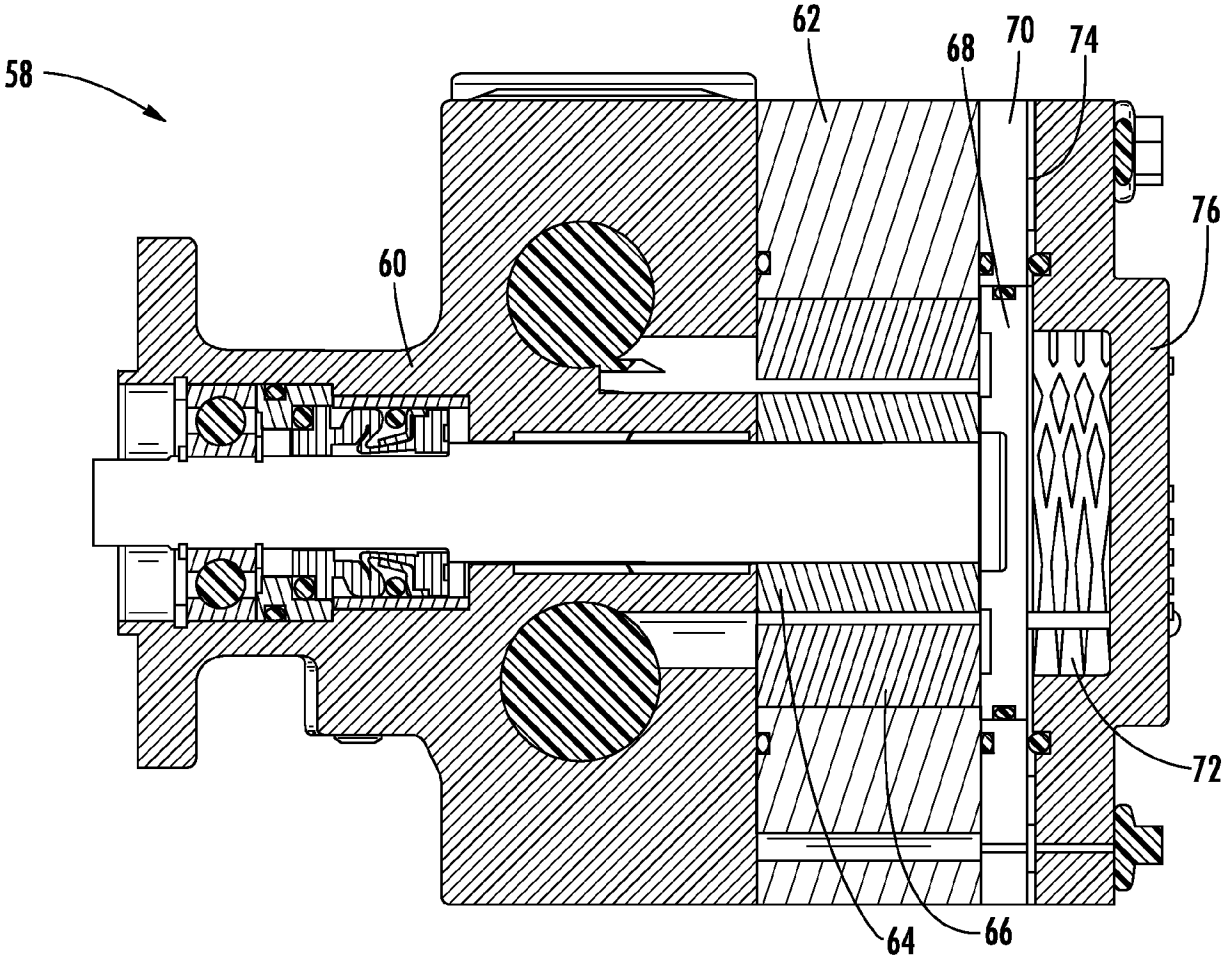
FIG. 18 is a cross-section assembled view of the gerotor pump of FIG. 17 taken along line C-C.

FIGS. 17 and 18 show an implementation of the disclosed design in a gerotor pump 58. The pump 58 of this embodiment is similar to that of the embodiment described in relation to FIGS. 1-16, with the exception that the pump of FIGS. 17 and 18 does not include a crescent plate. Thus, pump 58 includes a pump housing 60, gear housing 62, gerotor pinion gear 64, gerotor ring gear 66, side plate 68, side plate housing 70, spring 72, shim 74 and end plate 76.

The exemplary gerotor pump 58 may include some or all of the features of side plate adjustability as described in relation to the previously described embodiment. Thus, the spring 72 may be selected so that it acts to close the pump side face clearances over a low speed low pressure (i.e., startup) range of operation. This improves the efficiency of the pump in the operating range where prior designs are often inadequate. Once the startup conditions and pressures are exceeded, the side plate 68 moves to normal proven clearances (controlled by the shim 74 thickness) allowing the pump to operate at high pressures and low viscosities at elevated speeds with minimal reliability issues.

Figure 19:
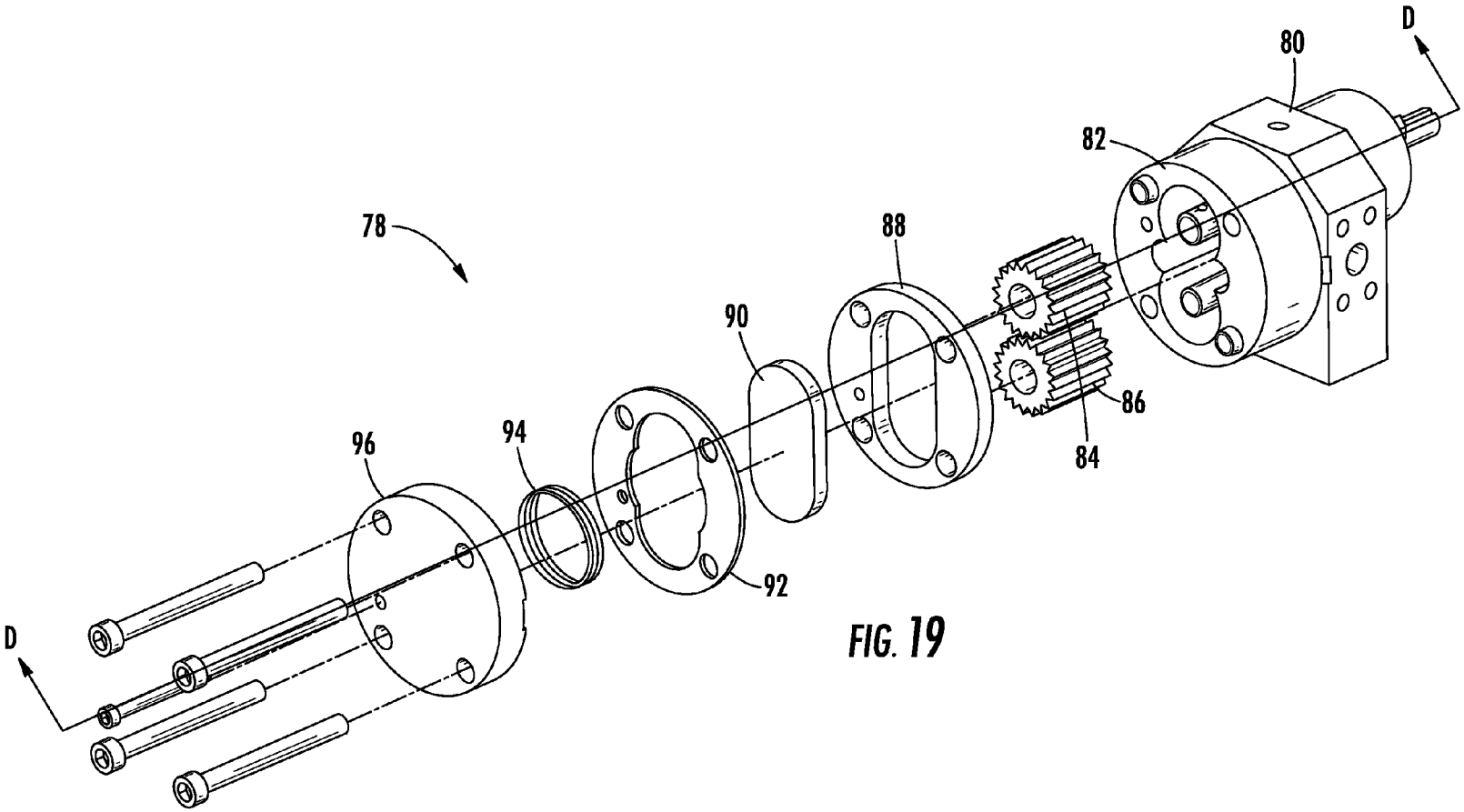
FIG. 19 is an exploded view of an exemplary external gear pump according to the disclosure.
Figure 20:
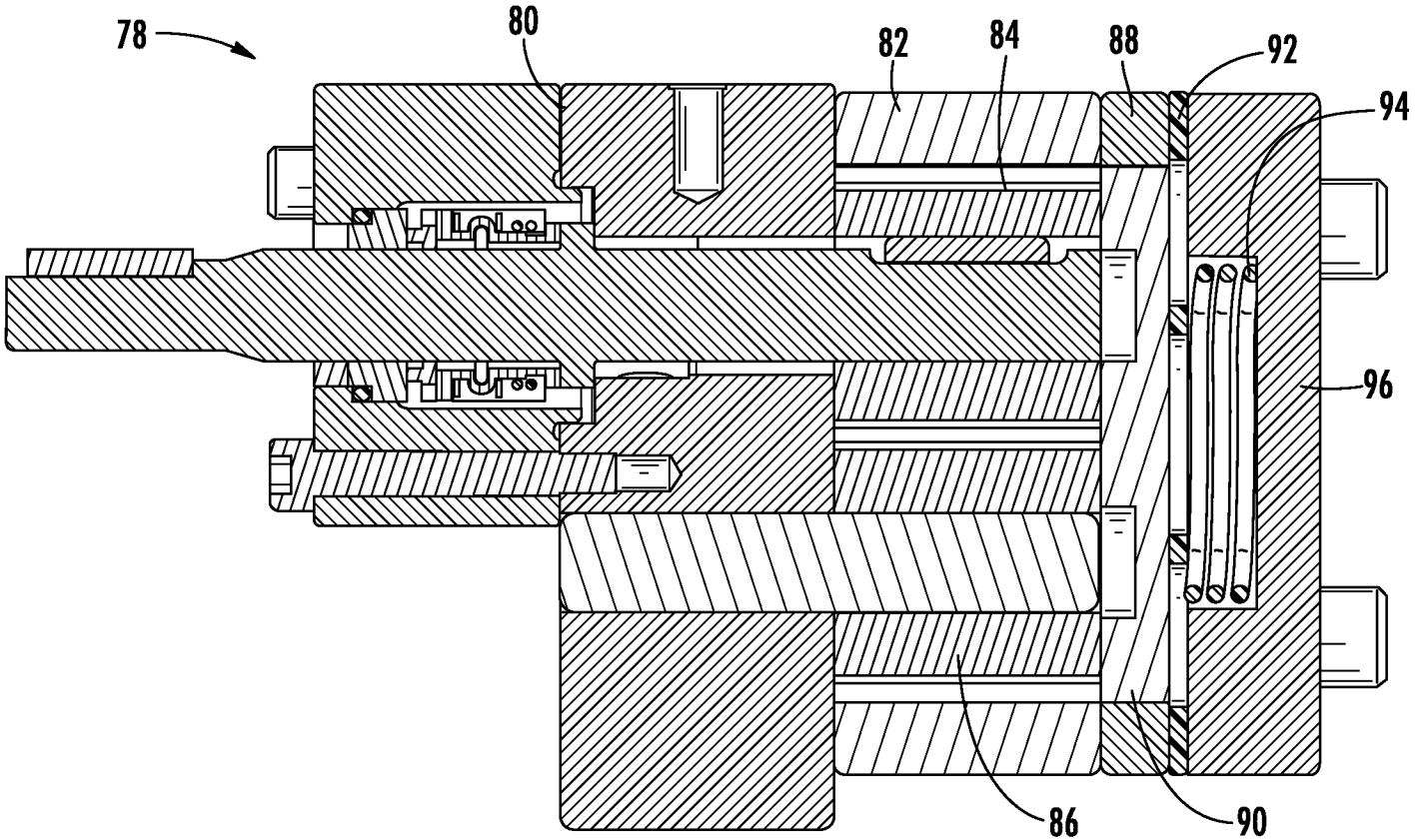
FIG. 20 is a cross-section assembled view of the external gear pump of FIG. 19 taken along line D-D.

FIGS. 19 and 20 show a further implementation of the disclosed design in an external gear pump 78. The pump 78 of this embodiment is similar to that of the embodiments described in relation to FIGS. 1-16, with the exception that the pump of FIGS. 19 and 20 does not include a crescent plate. Thus, pump 78 includes a pump housing 80, gear housing 82, first and second gears 84, 86, side plate 90, side plate housing 88, spring 94, shim 92 and end plate 96. As can be seen, in this embodiment, the side plate 90 has an elongated shape that conforms generally to an outline of the first and second gears 84, 86.

The exemplary external gear pump 78 may include some or all of the features of side plate adjustability as described in relation to the previously described embodiments. Thus, the spring 94 may be selected so that it acts to close the pump side face clearances over a low speed low pressure (i.e., startup) range of operation, thus improving the efficiency of the pump in the operating range where prior designs are often inadequate. Once the startup conditions and pressures are exceeded, the side plate 90 moves to normal proven clearances (controlled by the thickness of shim 92) allowing the pump 78 to operate at high pressures and low viscosities at elevated speeds with minimal reliability issues.

It will also be appreciated that the manufacturing methods described in relation to FIGS. 4-7 can apply equally to the pumps 58, 78 of FIGS. 17-20. Namely, the side plate-facing surfaces of the gear housing 62, pinion gear 64 and ring gear 66 of the gerotor pump 58 are all match ground as an assembly during the manufacturing process. The side plate housing 70 and side plate 68 are also match ground as an assembly during the manufacturing process. Similarly, for external gear pump 78, the side plate-facing surfaces of the gear housing 82 and first and second gears 84, 86 of the external gear pump 78 are all match ground as an assembly during the manufacturing process. The side plate housing 88 and side plate 90 are also match ground as an assembly during the manufacturing process.

As previously noted, this process has several distinct advantages over conventional methods. It eliminates the labor intensive task of setting side face clearances at assembly where the operator has to manually lap either the gears or housings and then repeatedly check the clearances of three parts with a gage until they are correct. With the pre match ground components the operator simply inserts the shim 74, 92 between the end cover 76, 96 and side plate housing 70, 88 and bolts the pump together. The shim 74, 92 precisely sets the side plate 68, 90 clearances and does so without variation from one side to the other.

The disclosed design can provide improved efficiency and reliability as compared to prior designs. The disclosed design can be applied to any viscous pumping application where a pressure profile that increases with speed is known. This is true of many if not most positive displacement pumping applications.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A self-adjusting gear pump, comprising:

a gear housing with first and second gears disposed therein;

a side plate housing coupled to the gear housing;

a side plate positioned within the side plate housing, the side plate having first and second opposing faces;

an end plate coupled to the side plate housing; and a shim member coupled between the side plate housing and the end plate;

wherein the side plate is axially movable between a first position in which the first face contacts respective faces of the first gear, second gear and gear housing, and a second position in which the second face contacts the end plate; and wherein the first face of the side plate is biased toward the first position via a spring positioned between the side plate and the end plate.

2. The self-adjusting gear pump of claim 1, wherein the side plate is movable from the first position to the second position when a discharge pressure of the self-adjusting gear pump exceeds a force of the spring.

3. The self-adjusting gear pump of claim 1, wherein the shim has a thickness equal to a distance between the first face of the side plate and the respective faces of the first and second gears and gear housing when the side plate is in the second position.

4. The self-adjusting gear pump of claim 1, wherein the spring is a coil spring.

5. The self-adjusting gear pump of claim 1, wherein the first gear is a pinion gear and the second gear is a ring gear, the self-adjusting gear pump further comprising a crescent plate comprising a plate portion and a crescent portion, the crescent plate coupled to the gear housing so that the crescent portion extends into the gear housing and is disposed between the pinion gear and the ring gear.

6. The self-adjusting gear pump of claim 5, further comprising a pump housing coupled to the crescent plate, the pump housing including first and second protrusions disposed within first and second openings in the crescent plate, wherein the first and second openings are elongated to allow limited lateral movement of the crescent plate with respect to the pump housing during assembly.

7. The self-adjusting gear pump of claim 6, wherein the first and second elongated openings have an elongation axis oriented to allow the crescent portion to be moved into engagement with the pinion gear and the ring gear during assembly.

8. The self-adjusting gear pump of claim 6, wherein the first and second elongated holes are positioned on opposite lateral sides of the crescent portion such that the elongation axis intersects the crescent portion.

* * * * *